US010338523B2

(12) United States Patent
Yamane

(10) Patent No.: US 10,338,523 B2
(45) Date of Patent: Jul. 2, 2019

(54) IMAGE FORMING APPARATUS CAPABLE OF PREVENTING FINE PARTICLES FROM FLOWING OUT OF APPARATUS AND IMAGE FORMING METHOD

(71) Applicant: KYOCERA Document Solutions Inc., Osaka-shi, Osaka (JP)

(72) Inventor: Shinji Yamane, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/174,047

(22) Filed: Oct. 29, 2018

(65) Prior Publication Data

US 2019/0163122 A1 May 30, 2019

(30) Foreign Application Priority Data

Nov. 29, 2017 (JP) ..... 2017-229091

(51) Int. Cl.

| | |
|---|---|
| ***G03G 15/20*** | (2006.01) |
| ***G03G 21/20*** | (2006.01) |
| ***B65H 37/00*** | (2006.01) |
| ***B65H 29/12*** | (2006.01) |

(52) U.S. Cl.

CPC ..... *G03G 21/206* (2013.01); *B65H 29/125* (2013.01); *B65H 37/00* (2013.01); *G03G 15/2028* (2013.01)

(58) Field of Classification Search

CPC ..... G03G 15/2017; G03G 15/6573; G03G 21/206

USPC ..... 399/92, 93, 98, 99

See application file for complete search history.

(56) References Cited

U.S. PATENT DOCUMENTS

| | | | | |
|---|---|---|---|---|
| 7,228,087 | B2 * | 6/2007 | Nagase | G03G 15/6573 399/92 |
| 8,351,814 | B2 * | 1/2013 | Kasuga | G03G 21/206 399/92 |
| 8,509,646 | B2 * | 8/2013 | Shimizu | G03G 21/206 399/92 |

FOREIGN PATENT DOCUMENTS

JP 2017003835 A 1/2017

* cited by examiner

*Primary Examiner* — William J Royer

(74) *Attorney, Agent, or Firm* — Alleman Hall Creasman & Tuttle LLP

(57) ABSTRACT

An image forming apparatus includes a fixing portion, a sheet conveying portion, a first airflow generating portion, a setting processing portion, and a first drive processing portion. The fixing portion heats a sheet on which a toner image has been transferred to fix the toner image to the sheet. The sheet conveying portion conveys a sheet along a conveyance path that leads to a sheet discharge port via the fixing portion. The first airflow generating portion includes a first fan and generates an airflow flowing upstream from the fixing portion in a conveyance direction of the sheet. The setting processing portion sets a drive speed of the first fan based on either or both of a sheet size, and a conveyance interval at which the sheet conveying portion conveys the sheet. The first drive processing portion drives the first fan at the drive speed set by the setting processing portion.

10 Claims, 3 Drawing Sheets

IMAGE FORMING APPARATUS CAPABLE OF PREVENTING FINE PARTICLES FROM FLOWING OUT OF APPARATUS AND IMAGE FORMING METHOD

INCORPORATION BY REFERENCE

This application is based upon and claims the benefit of priority from the corresponding Japanese Patent Application No. 2017-229091 filed on Nov. 29, 2017, the entire contents of which are incorporated herein by reference.

BACKGROUND

The present disclosure relates to an electrophotographic image forming apparatus and an image forming method executed in the image forming apparatus.

An electrophotographic image forming apparatus includes a fixing device for heating a sheet on which a toner image has been transferred to fix the toner image to the sheet. It is known that in this type of image forming apparatus, fine particles such as Ultra Fine Particles (UFPs) and Volatile Organic Compounds (VOCs) are generated when the toner image is heated by the fixing device. When the fine particles move from the fixing device along a conveyance path of the sheet and flow out of the image forming apparatus, air around the image forming apparatus is contaminated, potentially causing harm to people's health. As a technology to deal with the problem, there is known a configuration that can prevent the fine particles from flowing out of the image forming apparatus by generating an airflow flowing in an opposite direction of a conveyance direction, on an upstream side of the fixing device in the conveyance direction in the conveyance path of the sheet.

SUMMARY

An image forming apparatus according to an aspect of the present disclosure includes a fixing portion, a sheet conveying portion, a first airflow generating portion, a setting processing portion, and a first drive processing portion. The fixing portion heats a sheet on which a toner image has been transferred to fix the toner image to the sheet. The sheet conveying portion conveys a sheet along a conveyance path leading to a sheet discharge port via the fixing portion. The first airflow generating portion includes a first fan and is configured to generate an airflow flowing upstream from the fixing portion in a conveyance direction of the sheet. The setting processing portion sets a drive speed of the first fan based on either or both of a size of the sheet conveyed by the sheet conveying portion, and a conveyance interval at which the sheet is conveyed by the sheet conveying portion. The first drive processing portion drives the first fan at the drive speed set by the setting processing portion.

An image forming method according to another aspect of the present disclosure is executed in an image forming apparatus including a fixing portion configured to heat a sheet on which a toner image has been transferred to fix the toner image to the sheet, a sheet conveying portion configured to convey a sheet along a conveyance path leading to a sheet discharge port via the fixing portion, and a first airflow generating portion that includes a first fan and is configured to generate an airflow flowing upstream from the fixing portion in a conveyance direction of the sheet, and includes a setting step and a driving step. The setting step is a step of setting a drive speed of the first fan based on either or both of a size of the sheet conveyed by the sheet conveying portion, and a conveyance interval at which the sheet is conveyed by the sheet conveying portion, and the driving step is a step of driving the first fan at the drive speed set by the setting step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Figure 1:
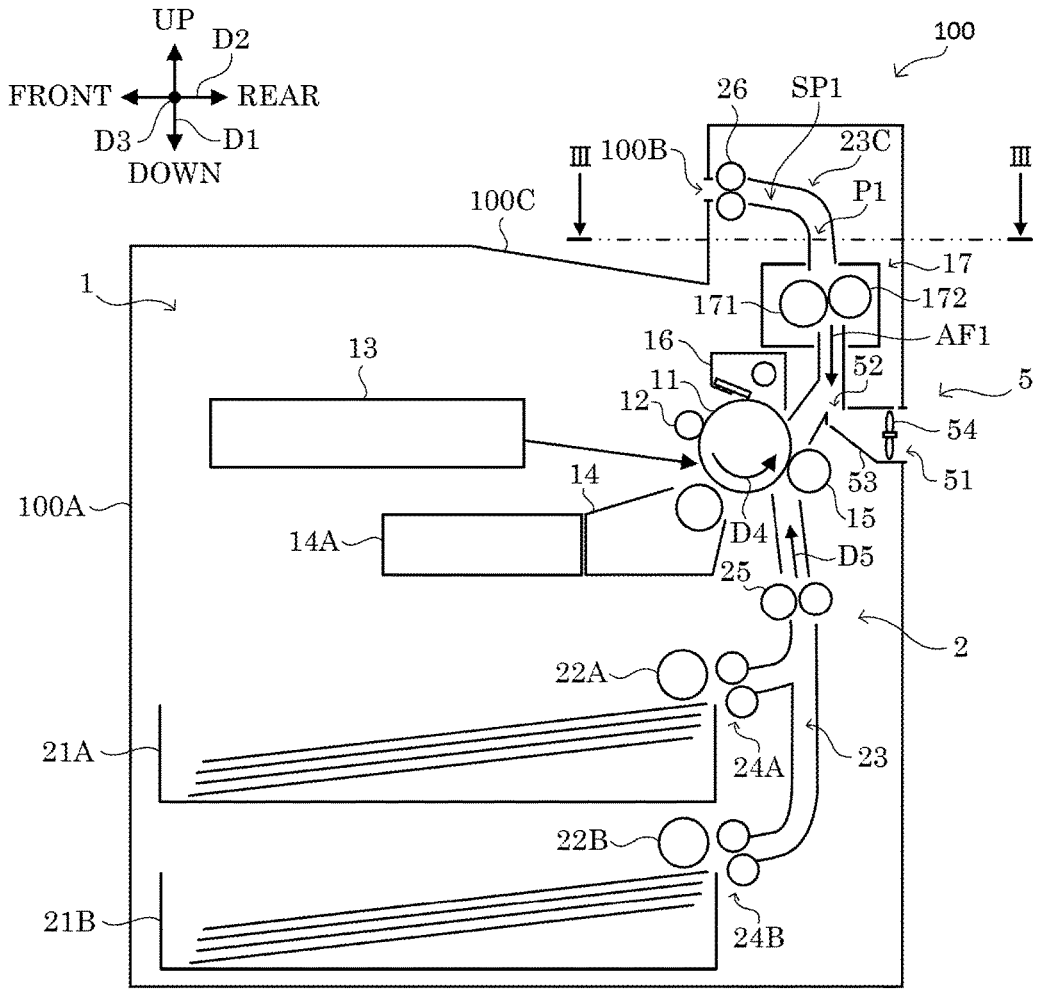
FIG. 1 is a diagram showing a configuration of an image forming apparatus according to an embodiment of the present disclosure.
Figure 2:
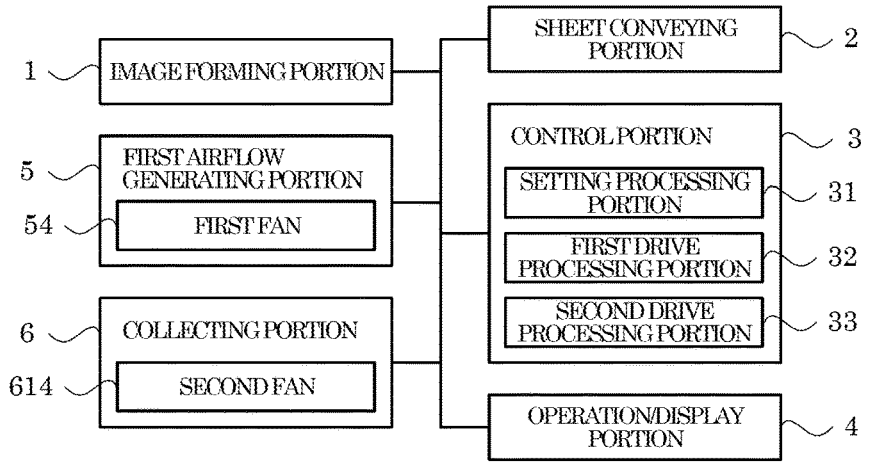
FIG. 2 is a block diagram showing a system configuration of the image forming apparatus according to the embodiment of the present disclosure.

First, a description is given of a configuration of an image forming apparatus 100 according to the embodiment of the present disclosure with reference to FIG. 1 and FIG. 2. Here, FIG. 1 is a cross-sectional diagram showing the configuration of the image forming apparatus 100.

It is noted that, for convenience of explanation, a vertical direction in an installation state (as shown in FIG. 1) where the image forming apparatus 100 is installed in a usable manner is defined as an up-down direction D1. In addition, a front-rear direction D2 is defined on the basis that a leftward side of the image forming apparatus 100 shown in FIG. 1 is the front side (front face). In addition, a left-right direction D3 is defined with reference to the front face of the image forming apparatus 100 in the installation state.

The image forming apparatus 100 is a printer including a printing function for forming an image based on image data. It is noted that the present disclosure is applicable to an image forming apparatus such as a facsimile apparatus, a copier, or a multifunctional peripheral.

As shown in FIG. 1 and FIG. 2, the image forming apparatus 100 includes an image forming portion 1, a sheet conveying portion 2, a control portion 3, an operation/display portion 4, a first airflow generating portion 5, and a collecting portion 6.

The image forming portion 1, the sheet conveying portion 2, the control portion 3, the first airflow generating portion 5, and the collecting portion 6 are stored in a housing 100A of the image forming apparatus 100 (see FIG. 1). The operation/display portion 4 is provided on an upper surface of the housing 100A. As shown in FIG. 1, a sheet discharge port 100B and a sheet discharge portion 100C are formed on an upper portion of the housing 100A, wherein the sheet discharge port 100B opens toward the front, and sheets discharged from the sheet discharge port 100B are stacked on the sheet discharge portion 100C.

The image forming portion 1 is configured to electrographically form an image based on image data input from an external information processing device such as a personal computer. As shown in FIG. 1, the image forming portion 1 includes a photoconductor drum 11, a charging device 12, a laser scanning unit 13, a developing device 14, a transfer roller 15, a cleaning device 16, and a fixing device 17.

The photoconductor drum 11 includes a rotational shaft extending in the left-right direction D3, and is rotatably supported on the center of the rotational shaft by the housing 100A. The photoconductor drum 11 receives rotational driving force transmitted from a motor (not shown), and rotates in a rotational direction D4 shown in FIG. 1. An electrostatic latent image is formed on a surface of the photoconductor drum 11.

The charging device 12 charges the surface of the photoconductor drum 11. For example, the charging device 12 includes a charging roller provided in contact with the surface of the photoconductor drum 11.

The laser scanning unit 13 forms the electrostatic latent image on the surface of the photoconductor drum 11. Specifically, the laser scanning unit 13 irradiates light based on image data onto the surface of the photoconductor drum 11 that has been charged by the charging device 12.

The developing device 14 develops the electrostatic latent image formed on the surface of the photoconductor drum 11 using developer that includes toner.

The transfer roller 15 is provided in a way that it comes in contact with the photoconductor drum 11. At a position where the transfer roller 15 comes in contact with the photoconductor drum 11, the transfer roller 15 transfers a toner image formed on the surface of the photoconductor drum 11 to a sheet being conveyed by the sheet conveying portion 2.

The cleaning device 16 cleans the surface of the photoconductor drum 11 after the toner image is transferred by the transfer roller 15. For example, the cleaning device 16 includes a blade-like cleaning member and a conveying screw, wherein the cleaning member removes remaining toner from the surface of the photoconductor drum 11, and the conveying screw conveys the toner removed by the cleaning member to a toner storing container (not shown).

The fixing device 17 heats the sheet to which the toner image has been transferred by the transfer roller 15, and fixes the transferred toner image on the sheet. As shown in FIG. 1, the fixing device 17 includes a fixing member 171 and a pressure member 172. For example, the fixing member 171 and the pressure member 172 are roller-like members. The fixing member 171 includes a heat source such as a halogen heater inside thereof, and is configured to heat the sheet on which the toner image has been transferred. The pressure member 172 is provided pressed against the fixing member 171 to form a nip portion therebetween, and is configured to press a sheet passing through the nip portion. Here, the fixing device 17 is an example of a fixing portion in the present disclosure.

The sheet conveying portion 2 conveys a sheet along a conveyance path leading to the sheet discharge port 100B via the transfer roller 15 and the fixing device 17. As shown in FIG. 1, the sheet conveying portion 2 includes a sheet feeding cassette 21A, a sheet feeding cassette 21B, a pick-up roller 22A, a pick-up roller 22B, a conveyance path 23, a feed roller 24A, a feed roller 24B, a registration roller 25, and a discharge roller 26.

The sheet feeding cassette 21A stores one or more sheets on which images are formed by the image forming portion 1. As shown in FIG. 1, the sheet feeding cassette 21A is provided in a bottom portion of the housing 100A. For example, the sheet feeding cassette 21A stores sheet members such as paper, coated paper, postcards, envelopes, or OHP sheets. A lift plate (not shown) is provided in the sheet feeding cassette 21A for lifting up the one or more sheets to a position where an uppermost sheet comes in contact with the pick-up roller 22A.

As shown in FIG. 1, the sheet feeding cassette 21B is provided below the sheet feeding cassette 21A. The sheet feeding cassette 21B has the same configuration as the sheet feeding cassette 21A, except for a size of a sheet stored therein. For example, the sheet feeding cassette 21A stores a portrait-orientation A4 size sheet. In addition, the sheet feeding cassette 21B stores a portrait-orientation A3 size sheet. It is noted that the sheet feeding cassette 21B may store sheets of a different type from those stored in the sheet feeding cassette 21A.

The pick-up roller 22A is provided in correspondence to the sheet feeding cassette 21A, and is configured to convey the uppermost sheet of the one or more sheets stored in the sheet feeding cassette 21A to the conveyance path 23. The pick-up roller 22B is provided in correspondence to the sheet feeding cassette 21B, and is configured to convey an uppermost sheet of one or more sheets stored in the sheet feeding cassette 21B to the conveyance path 23. The pick-up roller 22A and the pick-up roller 22B convey the sheets at a conveyance interval that is set by the control portion 3.

The conveyance path 23 is a movement path for a sheet formed to extend from the sheet feeding cassette 21A and the sheet feeding cassette 21B provided in the bottom portion of the housing 100A, to the sheet discharge port 100B provided in the upper portion of the housing 100A. As shown in FIG. 1, the conveyance path 23 extends inside the housing 100A in the up-down direction D1. The conveyance path 23 is formed by a pair of conveyance guide members 23A and 23B (see FIG. 3) provided inside the housing 100A.

As shown in FIG. 1, the transfer roller 15 and the fixing device 17 of the image forming portion 1 are disposed in the conveyance path 23. In addition, the feed roller 24A, the feed roller 24B, the registration roller 25, and the discharge roller 26 are disposed in the conveyance path 23. The feed roller 24A, the feed roller 24B, the registration roller 25, and the discharge roller 26 convey a sheet in a conveyance direction D5 shown in FIG. 1 by being rotated by a rotational driving force received from the motor.

In the image forming portion 1, an image is formed on a sheet conveyed by the sheet conveying portion 2 according to the following procedure.

First, the surface of the photoconductor drum 11 is uniformly charged to a specific potential by the charging device 12. Next, light is irradiated on the surface of the photoconductor drum 11 based on image data by the laser scanning unit 13. With this configuration, an electrostatic latent image corresponding to the image data is formed on the surface of the photoconductor drum 11.

The electrostatic latent image formed on the surface of the photoconductor drum 11 is developed (visualized) into a toner image by the developing device 14. The toner image formed on the surface of the photoconductor drum 11 is conveyed by the photoconductor drum 11 rotating in the rotational direction D4 to a position where the transfer roller 15 transfers the toner image. It is noted that toner is replenished to the developing device 14 from a toner container 14A that is detachable from the image forming portion 1 (see FIG. 1).

The sheet conveying portion 2 conveys a sheet to the transfer position in parallel with an image forming operation by the image forming portion 1. For example, when a sheet is conveyed from the sheet feeding cassette 21A, the lift plate lifts up one or more sheets stored in the sheet feeding cassette 21A to a position where an uppermost sheet comes in contact with the pick-up roller 22A. The pick-up roller 22A conveys the uppermost sheet of the one or more sheets lifted up by the lift plate to the conveyance path 23. The sheet conveyed to the conveyance path 23 by the pick-up roller 22A is conveyed to the registration roller 25 by the feed roller 24A.

The registration roller 25 conveys the sheet to the transfer position according to a timing of when the toner image on the photoconductor drum 11 is conveyed to the transfer position by rotation thereof. Specifically, in the image forming apparatus 100, a sheet sensor (not shown) is provided on an upstream side of the registration roller 25 in the conveyance direction D5 in the conveyance path 23. The control portion 3 sets a conveyance timing when the registration roller 25 should convey the sheet based on a detection timing when the sheet is detected by the sheet sensor. The registration roller 25 conveys the sheet to the transfer position at the conveyance timing set by the control portion 3. This allows for the toner image formed on the surface of the photoconductor drum 11 to be transferred to the sheet. It is noted that after the toner image is transferred, toner remaining on the surface of the photoconductor drum 11 is removed by the cleaning device 16.

The sheet to which the toner image was transferred at the transfer position is conveyed to the fixing device 17 by rotation of the photoconductor drum 11 and the transfer roller 15. In the fixing device 17, the toner image transferred to the sheet is heated and pressed by the fixing member 171 and the pressure member 172. With this configuration, the toner image is fixed to the sheet, and an image is formed on the sheet. Thereafter, the sheet on which the image has been formed is discharged from the sheet discharge port 100B to the sheet discharge portion 100C by the discharge roller 26.

The control portion 3 includes control devices such as a CPU, a ROM, and a RAM, all of which are not shown. The CPU is a processor for executing various types of arithmetic processing. The ROM is a nonvolatile storage device in which information such as a control program for the CPU to execute the various types of processing is preliminarily stored. The RAM is a volatile storage device used as a temporary storage memory (work area) for the various types of processing executed by the CPU. In the control portion 3, various types of control programs preliminarily stored in the ROM are executed by the CPU. This allows for the image forming apparatus 100 to be integrally controlled by the control portion 3. It is noted that the control portion 3 may be constituted by an electronic circuit such as an integrated circuit (ASIC), and may be provided separately from a main control portion that integrally controls the image forming apparatus 100.

The operation/display portion 4 includes a display portion and an operation portion, wherein the display portion is a liquid crystal display or the like for displaying various types of information in response to a control command from the control portion 3, and the operation portion includes a plurality of operation keys or a touch panel for inputting various types of information to the control portion 3 in response to an operation by a user.

Meanwhile, when the toner image is heated by the fixing device 17, fine particles such as Ultra Fine Particles (UFPs) and Volatile Organic Compounds (VOCs) are generated in the image forming apparatus 100. When the fine particles move along the conveyance path 23 from the fixing device 17 and flow out of the image forming apparatus 100, air around the image forming apparatus 100 is contaminated, potentially causing harm to people's health. To prevent this problem, the first airflow generating portion 5 and the collecting portion 6 are provided in the image forming apparatus 100 as described below.

[Configuration of First Airflow Generating Portion 5 and Collecting Portion 6]

Figure 3:
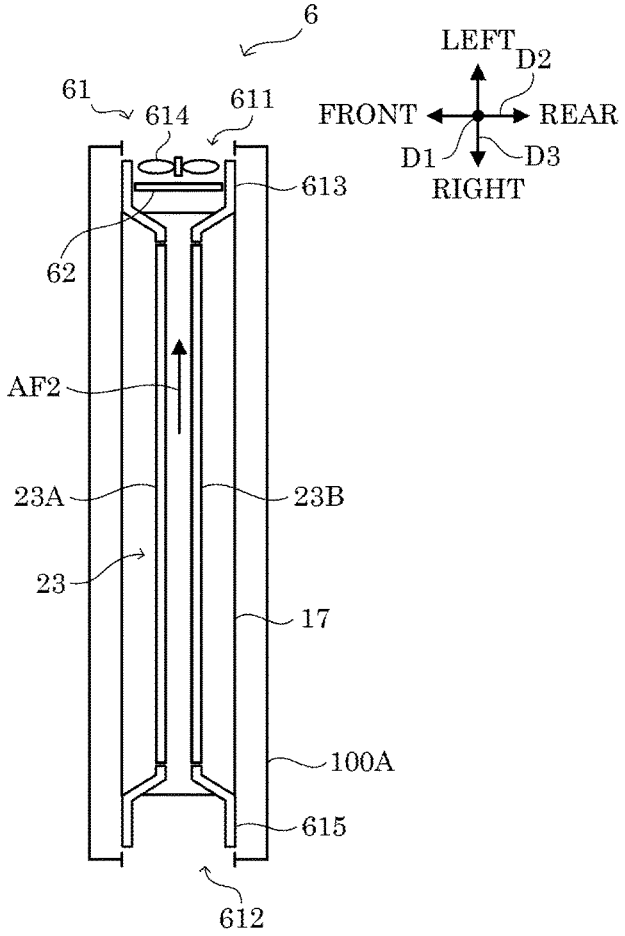
FIG. 3 is a diagram showing a configuration of a collecting portion in the image forming apparatus according to the embodiment of the present disclosure.

Next, with reference to FIG. 1 to FIG. 3, a description is given of configurations of the first airflow generating portion 5 and the collecting portion 6. Here, FIG. 3 is a cross-sectional diagram of a view along a line III-III in FIG. 1.

The first airflow generating portion 5 generates an airflow AF1 (see FIG. 1) flowing upstream in the conveyance direction D5 from the fixing device 17. As shown in FIG. 1 and FIG. 2, the first airflow generating portion 5 includes an exhaust port 51, an opening 52, a first duct 53, and a first fan 54.

As shown in FIG. 1, the exhaust port 51 is provided on an outer wall of a rear side of the housing 100A.

As shown in FIG. 1, the opening 52 is provided at a position in the conveyance path 23 on a downstream side of the transfer roller 15 in the conveyance direction D5, and on an upstream side of the fixing device 17 in the conveyance direction D5. The opening 52 opens toward the fixing device 17.

For example, among the pair of conveyance guide members 23A and 23B (see FIG. 3), the opening 52 is formed on the conveyance guide member 23B that faces a rear surface of the sheet being conveyed along the conveyance path 23. For example, the opening 52 is formed in a rectangular shape elongated in the left-right direction D3, on a center portion of the conveyance guide member 23B in the left-right direction D3.

The first duct 53 is a movement path for air, formed to extend from the exhaust port 51 to the opening 52.

The first fan 54 is an axial fan driven by electric power supplied from a first power source (not shown). The first fan 54 is provided facing the exhaust port 51 in the first duct 53. The first fan 54 generates an airflow flowing from inside the housing 100A to outside the housing 100A.

In the first airflow generating portion 5, air in the conveyance path 23 on a downstream side of the opening 52 in the conveyance direction D5 is drawn into the first duct 53 when the first fan 54 is driven. With this configuration, the airflow AF1 that flows upstream from the fixing device 17 in the conveyance direction D5 is generated. The airflow AF1 prevents the fine particles generated in the fixing device 17 from flowing out of the image forming apparatus 100. It is noted that the first airflow generating portion 5 may have a different configuration, as long as it can generate the airflow AF1. For example, the first airflow generating portion 5 may consist of only the first fan 54.

The collecting portion 6 collects the fine particles generated in the fixing device 17. As shown in FIG. 3, the collecting portion 6 includes a second airflow generating portion 61 and a collecting member 62.

The second airflow generating portion 61 generates an airflow AF2 (see FIG. 3) that flows in the left-right direction D3 that is a width direction of a sheet, at a collection position P1 (see FIG. 1) located in the conveyance path 23 on a downstream side of the fixing device 17 in the conveyance direction D5. As shown in FIG. 1, a section of the conveyance path 23 from the fixing device 17 to the discharge roller 26 includes a bent portion 23C that is bent forward. Specifically, the bent portion 23C is formed by the pair of conveyance guide members 23A and 23B (see FIG. 3) that are bent forward. The collection position P1 is located in the conveyance path 23 on an upstream side of the bent portion 23C in the conveyance direction D5. FIG. 3 shows a configuration around the conveyance path 23 at the collection position P1. It is noted that the collection position P1 may be a position where the bent portion 23C is disposed in the conveyance path 23.

As shown in FIG. 2 and FIG. 3, the second airflow generating portion 61 includes an exhaust port 611, an air supply port 612, a second duct 613, a second fan 614, and a third duct 615.

As shown in FIG. 3, the exhaust port 611 is provided in an outer wall of a left side of the housing 100A.

As shown in FIG. 3, the air supply port 612 is provided in an outer wall of a right side of the housing 100A.

The second duct 613 is a movement path for air, formed to extend from the exhaust port 611 to a left-side end of the conveyance path 23 at the collection position P1.

The second fan 614 is an axial fan driven by electric power supplied from a second power source (not shown). The second fan 614 generates airflow flowing from inside the housing 100A to the outside.

The third duct 615 is a movement path for air, formed to extend from the air supply port 612 to a right-side end of the conveyance path 23 at the collection position P1.

In the second airflow generating portion 61, when the second fan 614 is driven, air outside the housing 100A is drawn in from the air supply port 612 to the third duct 615, and air at the collection position P1 in the conveyance path 23 is drawn in to the second duct 613. With this configuration, the airflow AF2 that flows in the left-right direction D3 is generated. It is noted that the airflow AF2 may flow rightward, instead of leftward as shown in FIG. 3. For example, the second fan 614 may generate an airflow flowing into the housing 100A from the outside. In addition, the second airflow generating portion 61 may have a different configuration, as long as it can generate the airflow AF2. For example, the second airflow generating portion 61 may consist of only the second fan 614.

The collecting member 62 collects the fine particles included in the airflow AF2 that is generated by the second airflow generating portion 61. For example, the collecting member 62 is an activated carbon filter that collects the fine particles. As shown in FIG. 3, the collecting member 62 is provided in the second duct 613 on an upstream side of the second fan 614 in the airflow AF2. It is noted that in a case where the second fan 614 generates an airflow flowing into the housing 100A from the outside and the airflow AF2 flows rightward, the collecting member 62 is provided in the third duct 615.

It is noted that instead of the second air flow generating portion 61, the collecting portion 6 may be configured to generate an airflow flowing downstream from the fixing device 17 in the conveyance direction D5. For example, the collecting portion 6 may generate the airflow flowing downstream from the fixing device 17 in the conveyance direction D5 by the same configuration as the first air flow generating portion 5. In this case, the collecting member 62 collects the fine particles included in an airflow generated by the configuration.

Meanwhile, when a sheet exists in a conveyance space SP1 (see FIG. 1) between the fixing device 17 and the sheet discharge port 100B in the conveyance path 23, the sheet prevents the fine particles generated in the fixing device 17 from moving to the outside of the image forming apparatus 100. Here, in a case where a drive speed of the first fan 54 is uniformly set without consideration of conveyance conditions such as a sheet size and conveyance interval of the sheets conveyed through the conveyance space SP1, the airflow AF1 generated by the first air flow generating portion 5 may become unnecessarily strong and lower a temperature of the fixing device 17.

On the other hand, in the image forming apparatus 100 according to the embodiment of the present disclosure, it is possible, as described below, to prevent the fine particles from flowing to the outside of the image forming apparatus 100, and prevent the temperature of the fixing device 17 from decreasing.

Specifically, a drive control program for making the CPU of the control portion 3 execute a drive control process described below (see flowchart in FIG. 4) is stored in the ROM of the control portion 3. It is noted that the drive control program is recorded in a computer-readable recording medium such as a CD, a DVD, or a flash memory, and may be read from the recording medium and installed in a storage device provided in the image forming apparatus 100.

As shown in FIG. 2, the control portion 3 includes a setting processing portion 31, a first drive processing portion 32, and a second drive processing portion 33. Specifically, the control portion 3 executes the drive control program stored in the ROM by using the CPU. This allows for the control portion 3 to function as the setting processing portion 31, the first drive processing portion 32, and the second drive processing portion 33.

The setting processing portion 31 sets the drive speed of the first fan 54 based on the size of the sheets conveyed by the sheet conveying portion 2, and the conveyance interval at which the sheet conveying portion 2 conveys the sheets.

Specifically, the setting processing portion 31 sets the drive speed of the first fan 54 such that the larger an average value of a ratio of the sheets occupying the conveyance space SP1 (see FIG. 1) is, the lower the drive speed is, wherein the ratio is obtained for each predetermined time interval during a time period from when a sheet conveyed by the sheet conveying portion 2 reaches the fixing device 17 until when a time period corresponding to the conveyance interval at which the sheet conveying portion 2 conveys the sheets, elapses. For example, the time interval is 0.1 seconds.

For example, in the image forming apparatus 100, first table data in which a plurality of combinations of a sheet size and a conveyance interval respectively are associated with a plurality of the average values, is preliminarily stored in the ROM of the control portion 3. In addition, in the image forming apparatus 100, second table data in which the plurality of average values are associated with a plurality of drive speeds of the first fan 54, is preliminarily stored in the ROM of the control portion 3.

It is noted that the first table data may be acquired by performing a simulation based on a length of a section of the conveyance path 23 extending along the conveyance direction D5 from the fixing device 17 to the sheet discharge port 100B, a width of the conveyance path 23 in the left-right direction D3, a width of a space between the pair of conveyance guide members 23A and 23B, a sheet size, and a conveyance speed and conveyance interval at which the sheet conveying portion 2 conveys the sheets.

For example, a print job including setting information used to set execution conditions for a print process is transmitted from an external information processing device to the image forming apparatus 100. The print job transmitted from the external information processing device is received by a communication portion (not shown), and input to the control portion 3. When the print job is input to the control portion 3, the control portion 3 sets the execution conditions for the print process based on the setting information included in the input print job. After the execution conditions for the print process have been set, the control portion 3 executes the print process.

When the print job has been input, the setting processing portion 31 acquires the size of the sheets to be printed and the conveyance interval from the setting information included in the print job. In addition, based on the first table data, the setting processing portion 31 acquires an average value that corresponds to the combination of the sheet size and conveyance interval acquired from the setting information. In addition, based on the second table data, the setting processing portion 31 acquires a drive speed of the first fan 54 that corresponds to the acquired average value. Then, the setting processing portion 31 sets the drive speed of the first fan 54 by storing information indicating the acquired drive speed in a predetermined storage area of the RAM.

It is noted that in the image forming apparatus 100, the combination of the sheet size and conveyance interval may be directly associated with a drive speed of the first fan 54. In addition, a combination of the sheet size, a sheet thickness, and the sheet conveyance interval may be directly associated with a drive speed of the first fan 54, or indirectly associated with a drive speed of the first fan 54 via the average value.

In addition, the setting processing portion 31 may set the drive speed of the first fan 54 based on only the size of the sheets conveyed by the sheet conveying portion 2. In this case, the setting processing portion 31 sets the drive speed of the first fan 54 such that the larger an area of the sheets conveyed by the sheet conveying portion 2 is, or the larger a width (a length in the left-right direction D3) of the sheets conveyed by the sheet conveying portion 2 is, the lower the drive speed is.

In addition, the setting processing portion 31 may set the drive speed of the first fan 54 based on only the conveyance interval at which the sheet conveying portion 2 conveys the sheets. In this case, the setting processing portion 31 sets the drive speed of the first fan 54 such that the shorter the conveyance interval of the sheets being conveyed by the sheet conveying portion 2 is, the lower the drive speed is.

The first drive processing portion 32 drives the first fan 54 at the drive speed set by the setting processing portion 31.

For example, the first drive processing portion 32 drives the first fan 54 when execution of the print process begins. Specifically, the first drive processing portion 32 causes the first power source to output an amount of electric power corresponding to the drive speed set by the setting processing portion 31.

In addition, the first drive processing portion 32 stops driving the first fan 54 when a continuation time corresponding to the number of pages printed in the print process elapses from the end of the print process. Specifically, the first drive processing portion 32 stops output of electric power from the first power source.

For example, in the image forming apparatus 100, third table data in which a plurality of the numbers of pages to be printed in the print process are associated with a plurality of continuation times is preliminarily stored in the ROM of the control portion 3.

When a print job is input, the first drive processing portion 32 acquires the number of pages to be printed in the print process from the setting information included in the print job. Then, based on the third table data, the first drive processing portion 32 acquires a continuation time corresponding to the number of pages acquired from the setting information.

It is noted that the first drive processing portion 32 may stop driving the first fan 54 when a specific amount of time set irrespective to the execution conditions of the print process has elapsed from the end of the print process. In addition, the first drive processing portion 32 may stop driving the first fan 54 at the end of the print process in a case where, in place of the second air flow generating portion 61 of the collecting portion 6, a configuration is provided to generate an airflow flowing downstream in the conveyance direction D5 from the fixing device 17 as described above.

In addition, the first drive processing portion 32 may switch between driving and not driving the first fan 54 in response to whether or not the average value acquired by the setting processing portion 31 is lower than a predetermined threshold. Specifically, the first drive processing portion 32 may drive the first fan 54 when the average value acquired by the setting processing portion 31 is lower than the threshold, and not drive the first fan 54 when the average value is higher than or equal to the threshold. For example, the driving speeds of the first fan 54 corresponding to the average values that are higher than the threshold may be set to zero in the second table data.

The second drive processing portion 33 drives the second fan 614 at a predetermined first speed when the print process is executed. Specifically, the second drive processing portion 33 causes the second power supply to output an amount of electric power corresponding to the first speed.

In addition, when the print process ends, the second drive processing portion 33 changes a drive speed of the second fan 614 from the first speed to a second speed that is faster than the first speed. Specifically, the second drive processing portion 33 causes the second power source to output an amount of electric power corresponding to the second speed.

In addition, the second drive processing portion 33 stops driving the second fan 614 when the continuation time has elapsed from the end of the print process. Specifically, the second drive processing portion 33 stops output of electric power from the second power source.

It is noted that the second drive processing portion 33 may not change the drive speed of the second fan 614 when the print process ends. In addition, the second drive processing portion 33 may stop driving the second fan 614 when a predetermined amount of time has elapsed from when driving of the first fan 54 stopped.

In addition, the second drive processing portion 33 may switch the drive speed of the second fan 614 in response to whether or not the average value acquired by the setting processing portion 31 is lower than the threshold when the print process is executed. For example, the second drive processing portion 33 may drive the second fan 614 at the first speed when the average value acquired by the setting processing portion 31 is lower than the threshold, and drive the second fan 614 at a third speed (an example of a second speed in the present disclosure) that is faster than the first speed and slower than the second speed, when the average value is higher than or equal to the threshold.

[Drive Control Process]

Figure 4:
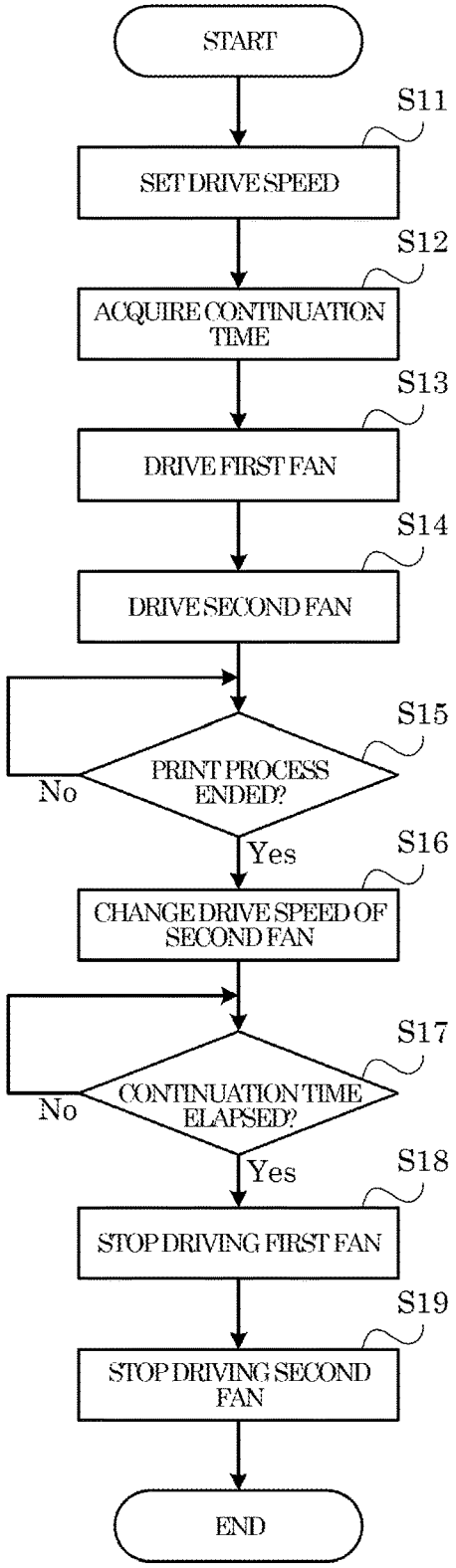
FIG. 4 is a flowchart showing an example of a drive control process executed in the image forming apparatus according to the embodiment of the present disclosure.

Hereinafter, with reference to FIG. 4, a description is given of an example of a procedure of the drive control process executed by the control portion 3 in the image forming apparatus 100, and an image forming method according to the present disclosure. Here, steps S11, S12, . . . represent numbers of processing procedures (steps) executed by the control portion 3. It is noted that the drive control process is executed when a print job is input to the control portion 3.

<Step S11>

First, in step S11, the control portion 3 sets the drive speed of the first fan 54. Here, processing in the step S11 is an example of a setting step in the present disclosure, and is executed by the setting processing portion 31 of the control portion 3.

For example, the control portion 3 acquires a size of the sheets to be printed and a sheet conveyance interval from the setting information included in the input print job. In addition, based on the first table data, the control portion 3 acquires an average value corresponding to the combination of the sheet size and conveyance interval acquired from the setting information. In addition, based on the second table data, the control portion 3 acquires a drive speed of the first fan 54 corresponding to the acquired average value. Then, the control portion 3 sets the drive speed of the first fan 54 by storing information indicating the acquired drive speed in the predetermined storage area of the RAM.

<Step S12>

In step S12, the control portion 3 acquires a continuation time. Here, processing in the step S12 is executed by the first drive processing portion 32 of the control portion 3.

For example, the control portion 3 acquires the number of pages to be printed from the setting information included in the input print job. Then, based on the third table data, the control portion 3 acquires a continuation time corresponding to the number of pages acquired from the setting information.

<Step S13>

In step S13, the control portion 3 drives the first fan 54 at the drive speed set in step S11. Here, processing in step S13 is an example of a driving step in the present disclosure, and is executed by the first drive processing portion 32 of the control portion 3.

For example, the control portion 3 drives the first fan 54 before the print process is executed based on the input print job. Specifically, the control portion 3 causes the first power source to output an amount of electric power corresponding to the drive speed set in step S11. This allows the airflow AF1 to be generated. Accordingly, the fine particles generated in the fixing device 17 during execution of the print process are prevented from moving downstream in the conveyance direction D5.

Here, the larger the size of the sheets conveyed in the print process is, the more the fine particles generated in the fixing device 17 are prevented from moving toward the sheet discharge port 100B by the sheets conveyed through the conveyance space SP1 between the fixing device 17 and the sheet discharge port 100B. In addition, the shorter the conveyance interval of the sheets conveyed in the print process is, the more the fine particles generated in the fixing device 17 are prevented from moving toward the sheet discharge port 100B by the sheet conveyed through the conveyance space SP1. Accordingly, in the image forming apparatus 100, the drive speed of the first fan 54 is set based on the size and conveyance interval of the sheets conveyed in the print process. Specifically, in the image forming apparatus 100, the drive speed of the first fan 54 is set in response to the average value that is specified based on the size and the conveyance interval of the sheets. This prevents the airflow AF1 from becoming unnecessarily strong. Accordingly, it is possible to prevent the airflow AF1 from lowering the temperature of the fixing device 17.

<Step S14>

In step S14, the control portion 3 drives the second fan 614 at the first speed. Here, processing in step S14 is executed by the second drive processing portion 33 of the control portion 3.

For example, the control portion 3 drives the second fan 614 before the print process is executed based on the input print job. Specifically, the control portion 3 causes the second power source to output an amount of electric power corresponding to the first speed. This generates the airflow AF2. Accordingly, the fine particles generated in the fixing device 17 during execution of the print process moving downstream in the conveyance direction D5 from the fixing device 17 are guided toward the collecting member 62 at the collection position P1 in the conveyance path 23.

Here, in the image forming apparatus 100, the fine particles generated in the fixing device 17 are guided toward the collecting member 62 by the airflow AF2 flowing in the left-right direction D3 that is orthogonal to the conveyance direction D5 of the sheet. With this configuration, the airflow guiding the fine particles toward the collecting member 62 does not directly come in contact with the fixing device 17. Accordingly, it is possible to prevent the temperature of the fixing device 17 from becoming lower, and catch the fine particles moving downstream from the fixing device 17 to prevent the fine particles from flowing out of the image forming apparatus 100.

<Step S15>

In the step S15, the control portion 3 determines whether or not the execution of the print process based on the input print job has ended.

Here, when the control portion 3 determines that the print process has ended (Yes in S15), the control portion 3 moves the process to step S16. In addition, when the control portion 3 determines that the print process has not ended (No in S15), the control portion 3 waits for the execution of the print process to end in step S15.

<Step S16>

In step S16, the control portion 3 changes the drive speed of the second fan 614 from the first speed to the second speed that is faster than the first speed. Here, processing in step S16 is executed by the second drive processing portion 33 of the control portion 3.

For example, the control portion 3 causes the second power source to output an amount of electric power corresponding to the second speed.

<Step S17>

In step S17, the control portion 3 determines whether or not the continuation time acquired in step S12 has elapsed from the end of the execution of the print process based on the input print job.

Here, when the control portion 3 determines that the continuation time has elapsed (Yes in S17), the control portion 3 moves the process to step S18. In addition, when the control portion 3 determines that the continuation time has not elapsed (No in S17), the control portion 3 waits for the continuation time to elapse in step S17.

<Step S18>

In step S18, the control portion 3 stops driving the first fan 54. Here, processing in step S18 is executed by the first drive processing portion 32 of the control portion 3.

For example, the control portion 3 stops output of electric power from the first power source.

<Step S19>

In step S19, the control portion 3 stops driving the second fan 614. Here, processing in step S19 is executed by the second drive processing portion 33 of the control portion 3.

For example, the control portion 3 stops output of electric power from the second power source.

Here, in the image forming apparatus 100, driving of the second fan 614 is stopped after the continuation time set in response to the number of pages to be printed has elapsed from the end of the print process. That is, in the image forming apparatus 100, the second fan 614 is continued to be driven after the end of the print process for an amount of time in response to an amount of the fine particles generated in the print process. With this configuration, it is possible to prevent the driving of the second fan 614 from being stopped in a state where the fine particles remain around the fixing device 17.

In addition, in the image forming apparatus 100, driving of the first fan 54 is stopped after the continuation time has elapsed from the end of the print process. With this configuration, it is possible to keep the fine particles remaining around the fixing device 17 in the same area even after the end of the print process. Accordingly, the capturing rate of the fine particles by the collecting portion 6 is improved.

As described above, in the image forming apparatus 100, the first fan 54 is driven at a drive speed set based on the size and conveyance interval of the sheets conveyed by the sheet conveying portion 2. With this configuration, it is possible to prevent the fine particles from flowing to the outside of the image forming apparatus 100, and prevent the temperature of the fixing device 17 from decreasing.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

a fixing portion configured to heat a sheet on which a toner image has been transferred to fix the toner image to the sheet;

a sheet conveying portion configured to convey a sheet along a conveyance path that leads to a sheet discharge port via the fixing portion;

a first airflow generating portion that includes a first fan and is configured to generate an airflow flowing upstream from the fixing portion in a conveyance direction in which the sheet conveying portion conveys the sheet;

a setting processing portion configured to set a drive speed of the first fan based on either or both of a size of the sheet conveyed by the sheet conveying portion, and a conveyance interval at which the sheet conveying portion conveys the sheet; and a first drive processing portion configured to drive the first fan at the drive speed set by the setting processing portion.

2. The image forming apparatus according to claim 1, wherein the setting processing portion is configured to set the drive speed of the first fan such that the larger an average value of a ratio of the sheet occupying a conveyance space is, the lower the drive speed is, wherein the ratio is obtained for each predetermined time interval during a time period from when a sheet conveyed by the sheet conveying portion reaches the fixing portion, until when a time period corresponding to the conveyance interval at which the sheet conveying portion conveys the sheet elapses.

3. The image forming apparatus according to claim 2, wherein the first drive processing portion drives the first fan when the average value is less than a predetermined threshold.

4. The image forming apparatus according to claim 3, further comprising a second airflow generating portion that includes a second fan and is configured to generate an airflow in the conveyance path along a width direction of the sheet on a downstream side of the fixing portion in the conveyance direction of the sheet, a collecting member configured to collect a plurality of fine particles included in the airflow generated by the second airflow generating portion, and a second drive processing portion configured to drive the second fan at a predetermined first speed when the average value is lower than the threshold, and drive the second fan at a second speed that is faster than the first speed when the average value is greater than or equal to the threshold.

5. The image forming apparatus according to claim 1, wherein the setting processing portion sets the drive speed of the first fan such that the larger an area of the sheet conveyed by the sheet conveying portion is, the lower the drive speed is.

6. The image forming apparatus according to claim 1, wherein the setting processing portion sets the drive speed of the first fan such that the larger a width of the sheet conveyed by the sheet conveying portion is, the lower the drive speed is.

7. The image forming apparatus according to claim 1, wherein the setting processing portion sets the drive speed of the first fan such that the shorter the conveyance interval at which the sheet conveying portion conveys the sheet is, the lower the drive speed is.

8. The image forming apparatus according to claim 1, further comprising a second airflow generating portion that includes a second fan and is configured to generate an airflow in the conveyance path along a width direction of the sheet on a downstream side of the fixing portion in the conveyance direction of the sheet, and a collecting member configured to collect a plurality of fine particles included in the airflow generated by the second airflow generating portion.

9. The image forming apparatus according to claim 1, wherein the first drive processing portion drives the first fan when execution of a print process is started, and stops driving the first fan when a continuation time set in response to a number of pages to be printed in the print process elapses from when the execution of the print process ended.

10. An image forming method executed in an image forming apparatus including a fixing portion configured to heat a sheet on which a toner image has been transferred to fix the toner image to the sheet, a sheet conveying portion configured to convey a sheet along a conveyance path that leads to a sheet discharge port via the fixing portion, and a first airflow generating portion that includes a first fan and is configured to generate an airflow flowing upstream from the fixing portion in a conveyance direction in which the sheet conveying portion conveys the sheet, comprising:

a setting step of setting a drive speed of the first fan based on either or both of a size of the sheet conveyed by the sheet conveying portion, and a conveyance interval at which the sheet conveying portion conveys the sheet; and a driving step of driving the first fan at the drive speed set by the setting step.

* * * * *